US005632316A

United States Patent [19]

Cohen

[11] Patent Number: 5,632,316

[45] Date of Patent: May 27, 1997

[54] VENETIAN BLIND WITH INDIVIDUALLY ADJUSTABLE SLATS

[76] Inventor: Leone A. Cohen, 9251 Southampton Pl., Boca Raton, Fla. 33434

[21] Appl. No.: 511,997

[22] Filed: Aug. 7, 1995

[51] Int. Cl.[6] ..... E06B 9/30

[52] U.S. Cl. ..... 160/168.1; 160/39; 160/178.1; 160/236

[58] Field of Search ..... 160/168.1 R, 166.1 R, 160/173 R, 178.1 R, 176.1 R, 177 R, 236, 39

[56] References Cited

U.S. PATENT DOCUMENTS

| | | | |
|---|---|---|---|
| 1,949,653 | 3/1934 | Moore | 160/168.1 R X |
| 2,103,395 | 12/1937 | Wade et al. | 160/168.1 R |
| 2,481,714 | 9/1949 | Bezjian | 160/168.1 R X |
| 2,837,152 | 6/1958 | Moore, Jr. | 160/168.1 R |
| 3,971,427 | 7/1976 | Coldewey et al. | 160/166 R |
| 3,991,518 | 11/1976 | Ishihara | 49/75 |
| 4,625,868 | 12/1986 | Bischof | 160/178.1 R X |
| 4,699,196 | 10/1987 | Elliott | 160/168 R |
| 4,817,698 | 4/1989 | Rossini et al. | 160/168.1 R X |
| 4,886,102 | 12/1989 | Debs | 160/178.1 R X |
| 5,054,534 | 10/1991 | Hong | 160/84.1 |
| 5,060,709 | 10/1991 | Simon | 160/168.1 R |
| 5,117,891 | 6/1992 | Simon | 160/263 |
| 5,127,459 | 7/1992 | Markowitz | 160/263 |
| 5,203,395 | 4/1993 | Koller et al. | 160/263 |
| 5,254,034 | 10/1993 | Roth | 454/277 |
| 5,271,447 | 12/1993 | Aronovich | 160/236 |
| 5,303,760 | 4/1994 | Perez | 160/236 |
| 5,341,864 | 8/1994 | Rupel et al. | 160/84.1 B |
| 5,386,867 | 2/1995 | Chen | 160/168.1 |

FOREIGN PATENT DOCUMENTS

| | | | |
|---|---|---|---|
| 2025441 | 3/1992 | Canada | 160/166.1 |
| 0491097 | 6/1992 | European Pat. Off. | 160/166.1 |
| 0491096 | 6/1992 | European Pat. Off. | 160/166.1 |
| 6409755 | 2/1966 | Netherlands | 160/166.1 |
| 0433678 | 9/1967 | Switzerland | 160/168.1 |
| 1000626 | 8/1965 | United Kingdom | 160/168.1 |

*Primary Examiner*—Blair Johnson
*Attorney, Agent, or Firm*—John C. Smith

[57] ABSTRACT

A venetian blind with individually adjustable slats. Each slat has a multilayer decorative slat extensions mounted in a slat extension holder. The individual slat extensions are mounted directly above one another in the unextended position. Each slat can be individually adjusted in length by sliding the slat extensions in opposite directions. The slats in the blind can be extended to allow the blind to be used on windows of varying width. Each slat can be individually adjusted to allow the blind to be used interchangeably on rectangular windows or on odd shaped windows such as arched windows. The cords used to control slat position and the cords used to raise and lower the slats are mounted on the edge of the slats which do not have holes.

20 Claims, 7 Drawing Sheets

Prior Art

VENETIAN BLIND WITH INDIVIDUALLY ADJUSTABLE SLATS

BACKGROUND OF THE INVENTION

1. Technical Field

The present invention relates to venetian blinds. In particular, to venetian blinds having individually adjustable slats and venetian blinds which do not have cord holes in the slats.

2. Background Art

Venetian blinds provide a convenient way to adjust the relative amount of light entering a room. However, due to their complicated structure, venetian blinds tend to be expensive. This is particularly true in regard to blinds which use decorative slats. It would be advantageous for the owner of venetian blinds to be able to conveniently change the slats on venetian blinds to accommodate changes in interior design. For example, to match changes in wallpaper, paint, etc.

In the area of vertical blinds, prior art attempts to replace vertical blind slats have been successful. Individual vertical slats are easily replaced because they generally are secured only at the top and do not have to accommodate cords for tilting or raising as do horizontal blinds. As a result, prior art systems are available which provide for easy replacement of vertical blinds. For example, prior art systems are known which use vertical blinds in which each blind contains a portion of a larger image. When the individual blind slats are assembled, the resulting blind displays a single image much like a mural. Because vertical blinds are easily replaceable, the image can be easily changed when desired. Other known vertical blind systems provide the ability to remove a vertical blind which is structured as a clear case with a replaceable insert for decorative purpose. These systems rely on the easy removal of vertical blinds which is based on the absence of cords.

While cosmetic replacement of vertical blinds is relatively easy, the replacement of horizontal slats on a venetian blind are relatively difficult and cannot be done by the user of the blinds without disassembly of the cords which extend from the headrail assembly through each of the slats. The prior art has failed to provide an easily replaceable venetian blind slat which permits a user to replace slats without tampering with the tilt or lift cords.

Another drawback to prior art systems is the extraneous light which penetrates venetian blinds though the cord holes in the slats. One prior art method of addressing this problem has been to position the cord holes such that when the venetian blinds are closed, the cord holes are covered by the slat which is adjacent to the slat with the cord hole. Of course, this method only works when the venetian blind is completely closed. If the blind is in any other position than closed, light will penetrate the cord holes. This method, therefore, only provides a partial solution to the problem of extraneous light.

Another attempt to address light penetration through cord holes has been in the area of pleated fabric shades. One solution in this area has been to manufacture pleated shades with dual fabric panels, each panel having a series of cord holes which are offset from the cord holes in the adjacent panel. The drawback to this approach has been the added cost of having dual panels. This method would not be feasible for venetian blind slats because the cost of the resulting blind would be too high.

While the prior art has recognized the problems associated with light penetration through cord holes, the solutions heretofore devised have been ineffective for venetian blinds because they do not work over the full range of slat tilting or are prohibitively expensive.

Another problem associated with prior art venetian blinds is the expense associated with custom building them to fit a particular window frame. The prior art has attempted to provide adjustable venetian blinds when used with rectangular window frames. However, due to the use of cord holes and the tilt and lift cords which are inserted through them, prior art designs are only suitable for rectangular windows. These solutions also are incapable of being adjusted to fit odd shaped windows because the tilt and lift cords require all of the slats to be moved in unison. As a result, they cannot be used with arched or angled windows and slat replacement for esthetic reasons is prevented by the presence of the cord holes and tilt and lift cords.

The prior art has failed to provide an adjustable venetian blind which allows a user to easily replace slats without removal or alteration of the tilt or lift cords; and adjustable venetian blind in which each slat can be individually adjusted can be adjusted for use with both rectangular windows or odd shaped or arched windows; and a venetian blind which reduces extraneous light penetration by eliminating cord holes.

SUMMARY OF THE INVENTION

The present invention solves the foregoing problems by providing a venetian blind with individually adjustable multilayer hole-less slats. Each multilayer slat has at least two decorative slat extensions mounted in a slat extension holder. The individual slat extensions are mounted directly above one another in the unextended position which provides the minimum width venetian blind. Each slat can be individually adjusted in length by sliding the individual slat extensions in opposite directions. A slat extension holder supports the slats as they are extended to fit windows of varying width. The length of each slat can be individually adjusted to allow the venetian blind to be used interchangeably on rectangular windows or on odd shaped windows such as arched windows. The cords used to control slat position and the cords used to raise and lower the slats are mounted on the edge of the slats. The cords are edge mounted on the slats to allow the slats to be manufactured without cord holes. The headrail has an additional hole at each end to provide an offset for the rear lifting cord

DESCRIPTION OF THE PREFERRED EMBODIMENT

Figure 1:
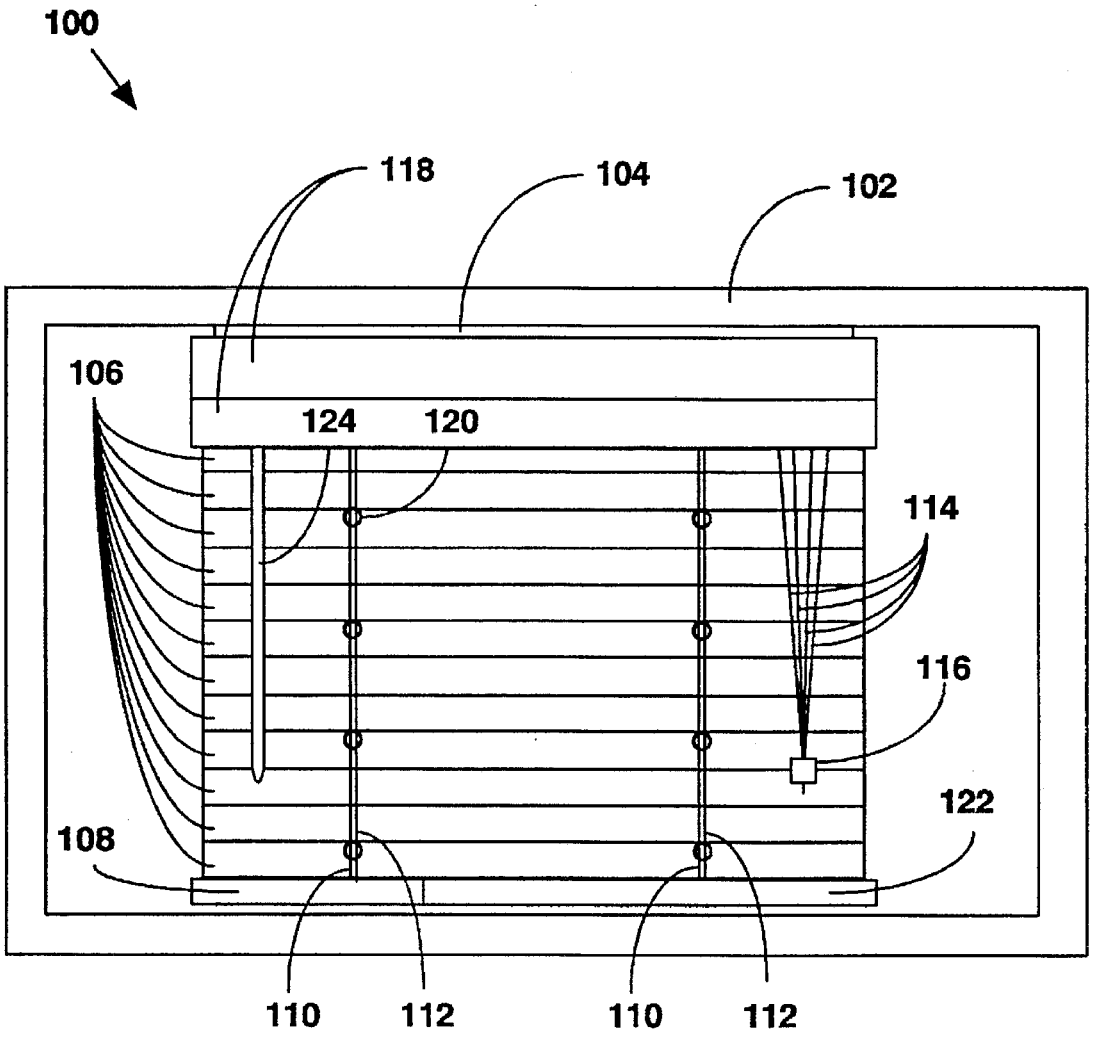
FIG. 1 is a front view of a preferred embodiment of the adjustable venetian blinds in the unextended position.

Referring to FIG. 1, a front view of a preferred embodiment of the adjustable venetian blind 100 is shown. In venetian blind 100, headrail 104 is attached to front tilt cords 110 and front lift cords 112. Headrail 104 has a conventional tilt cord drive assembly (not shown) and a conventional lift cord drive assembly. Tilt cord drive assemblies and lift cord drive assemblies are well known in the art. Adjustable slats 106 are suspended from slat rungs 308 (shown in FIG. 3) which are in turn attached to front tilt cords 110 and rear tilt cords 206 (shown in FIG. 2).

In the preferred embodiment, each end of the headrail 104 has one set of front and rear tilt cords 110, 206 and one set of front and rear lift cords 112, 204. Tilt control 124 is attached to headrail 104 and operates front and rear tilt cords 110, 206. The tilt control mechanism embodied in headrail 104 and tilt control 124 is a conventional tilt control mechanism, well known in the art. Front cord guides 120 are attached to the edge of adjustable slats 106. For ease of illustration, front cord guides 120 are shown enlarged. In the preferred embodiment, they are only large enough to accommodate movement of the tilt and lift cords 110, 112 selected for a particular venetian blind 100. As shown in FIG. 1, front cord guides 120 are not required on every adjustable slat 106.

Bottom rail segments 108, 122 are attached to front and rear lift cords in the conventional manner. Bottom rail segments 108, 122 are designed to telescope such that they can be extended when adjustable venetian blind 100 is extended. Lifting cords 114 are shown attached to cord clamp 116. Lifting cords 114 are also attached to headrail 104 in the conventional manner. Decorative valance panels 118 are shown attached to headrail 104.

In this figure, venetian blind 100 is shown mounted in window frame 102 in the unextended position. In the unextended position, venetian blind 100 has the minimum width. A principle advantage of this embodiment is the ability to extend adjustable slats 106 such that the width of venetian blind 100 can be varied. As a result, the same size venetian blind 100 can be used on a variety of window sizes. By using a single size for a variety of window sizes, venetian blinds 100 can be manufactured less expensively.

Another advantage of the invention is also illustrated in FIG. 1. In particular, the adjustable slats 106 do not have cord holes because tilt and lift cords 110, 112, 204, 206 are routed along the edge of adjustable slats 106. As a result, light penetration caused by cords holes is eliminated.

Figure 2:
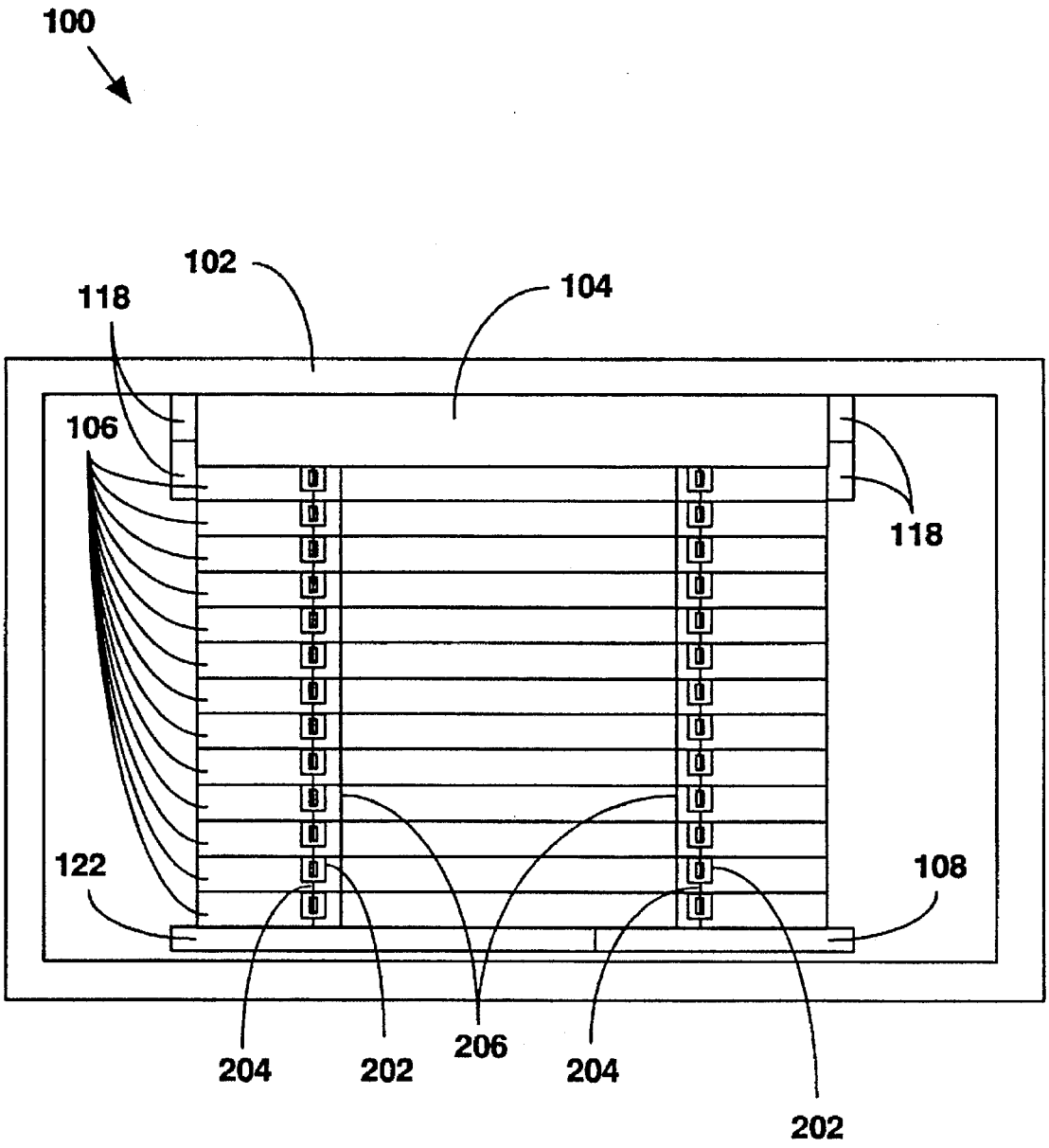
FIG. 2 is a rear view of the embodiment of FIG. 1 in the unextended position.

FIG. 2 illustrates a rear view of venetian blind 100 in the unextended position. Rear lift cords 204 are offset from rear tilt cords 206 in the preferred embodiment by routing rear lift cords 204 through lift cord guides 202. Lift cord guides 202 are attached to the bottom of adjustable slats 106. In the preferred embodiment, lift cord guides 202 are made from an inexpensive material such as plastic, polyethylene, etc. and attached to the bottom of slat extension holder 306 via adhesive. However, any suitable material can be used to fabricate lift cord guides 202 and any suitable method of attachment can be implemented. By routing rear lift cords 204 through lift cord guides 202, the relative position of the adjustable slats 106 to one another is stabilized. The attachment of lift cord guides 202 is explained more fully below in regard to FIG. 3.

Figure 3A:
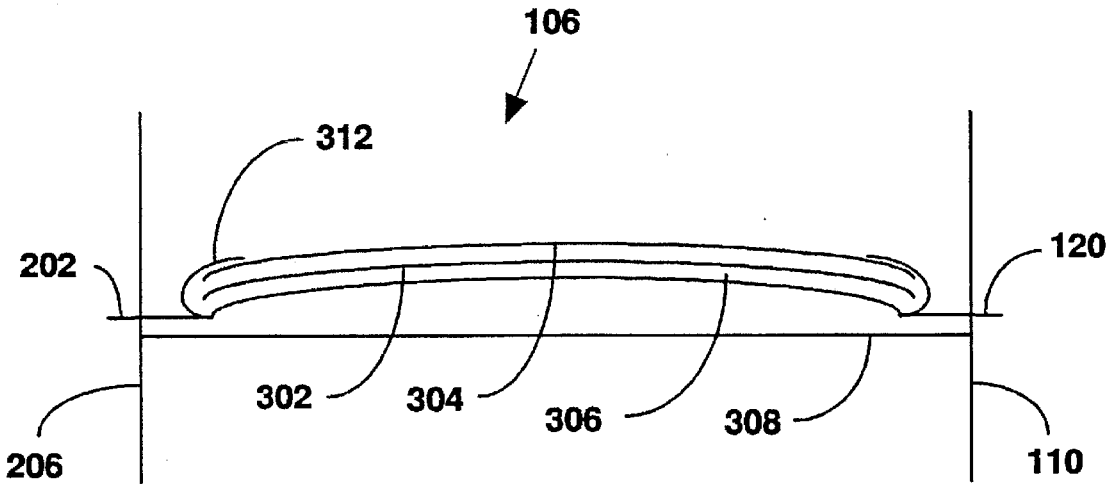
FIG. 3A is an end view of an adjustable slat in the preferred embodiment. This view illustrates the location of the slat extensions in the slat extension holder.
Figure 3B:
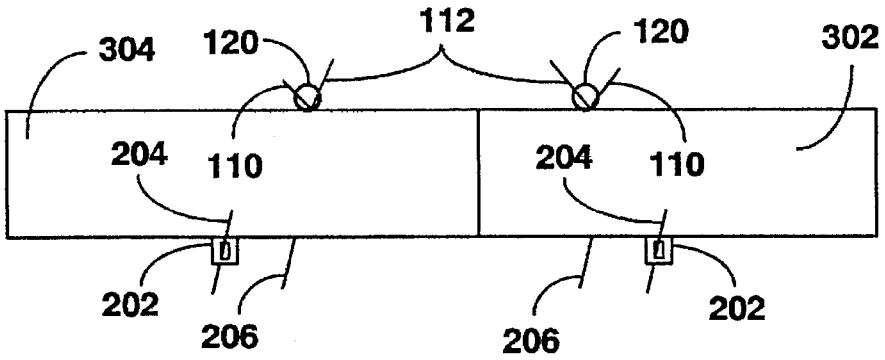
FIG. 3B is a top view of an adjustable slat in the preferred embodiment. This view illustrates the slat extensions in an extended position.
Figure 3C:
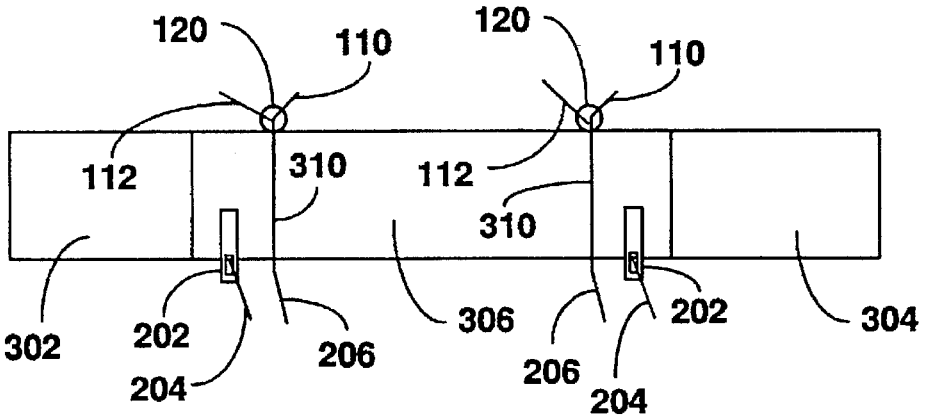
FIG. 3C is a bottom view of an adjustable slat in the preferred embodiment. This view illustrates the slat extensions in an extended position and the slat extension support.

FIGS. 3A–C are detailed views of an adjustable slat 106. FIG. 3A is an end view of an adjustable slat 106 which illustrates its multi-layer structure. Slat extensions 304 rests on top of slat extension 302 and both are held under pressure at their edges by slat extension grips 312 at the edge of slat extension holder 306. Slat extensions 302, 304 do not have to be the same size. Cord guide 120 is attached to the edge of adjustable slat 306 and encircles tilt cord 110. Lift cord guide 202 is attached to the edge bottom of slat extension holder 306. Adjustable slat 106 rests on slat rung 308 which is attached at one end to front tilt cord 110 and at the other end to rear tilt cord 206. Rear lift cord 204 (shown in FIG. 3B) is inserted through rear lift cord guide 202.

When slat extension 304 rests directly on top of slat extension 302, the adjustable venetian blind 100 is at its minimum width. By sliding slat extension 302 in one direction and slat extension 304 in the opposite direction, the total width of an individual slat 106 can be extended to fit a particular window size. Those skilled in the art will recognize that the thinner slat extensions 302, 304 are, the less visible the edge of slat 304 will be when slats 302, 304 are extended.

As shown in FIG. 3A, the front and rear tilt and lift cords 110, 112,204, 206 are mounted at the edges of slat 106. Therefore, each individual slat 106 can be independently adjusted since there is no need to maintain cord holes in alignment between adjacent slats 106. The edges of slat extension holder 30 are folded over and hold slat extensions 302, 304 under sufficient pressure to avoid inadvertent slippage, but are loose enough to allow a user to manually slide slat extensions 302, 304 to the desired slat width.

FIG. 3B is a top view of a slat 106 in an extended position. Upper slat extension 304 is shown extended past the left end of the slat 106 and slat extension 302 is shown extended past the right end of slat 106. As a result, the total length of slat 106 is increased.

FIG. 3C is a bottom view of slat 106 showing slat extension holder 306 with slat extensions 302, 304 extended past the end of slat extension holder 306 to increase the total width of slat 106. Also shown in this figure is lift cord guide 202. In the preferred embodiment, lift cord guide 202 is secured to the bottom of slat extension holder 306. By routing lift cord 204 through lift cord guide 202, slat 106 is stabilized and slippage is reduced. Further, by offsetting lift cord guide 202 from tilt cord 206, the lift cord guide 202 is prevented from interfering with the operation of tilt cords 110, 206.

Those skilled in the art will recognize that the slat extensions 302,304 can be made from any suitable material such as plastic, fabric, etc. Likewise, while the slat extension holder 306 can be made from any suitable material, the preferred embodiment envisions a clear plastic to facilitate replacement of the slat extensions 302, 304 without regard to the color of the replacement extension slats 302, 304.

In addition, those skilled in the art will also recognize that the rungs 308 can be eliminated if the front and rear tilt cords 110, 206 are attached directly to the slat extension holder 306. However, the preferred embodiment uses conventional rungs.

Figure 4:
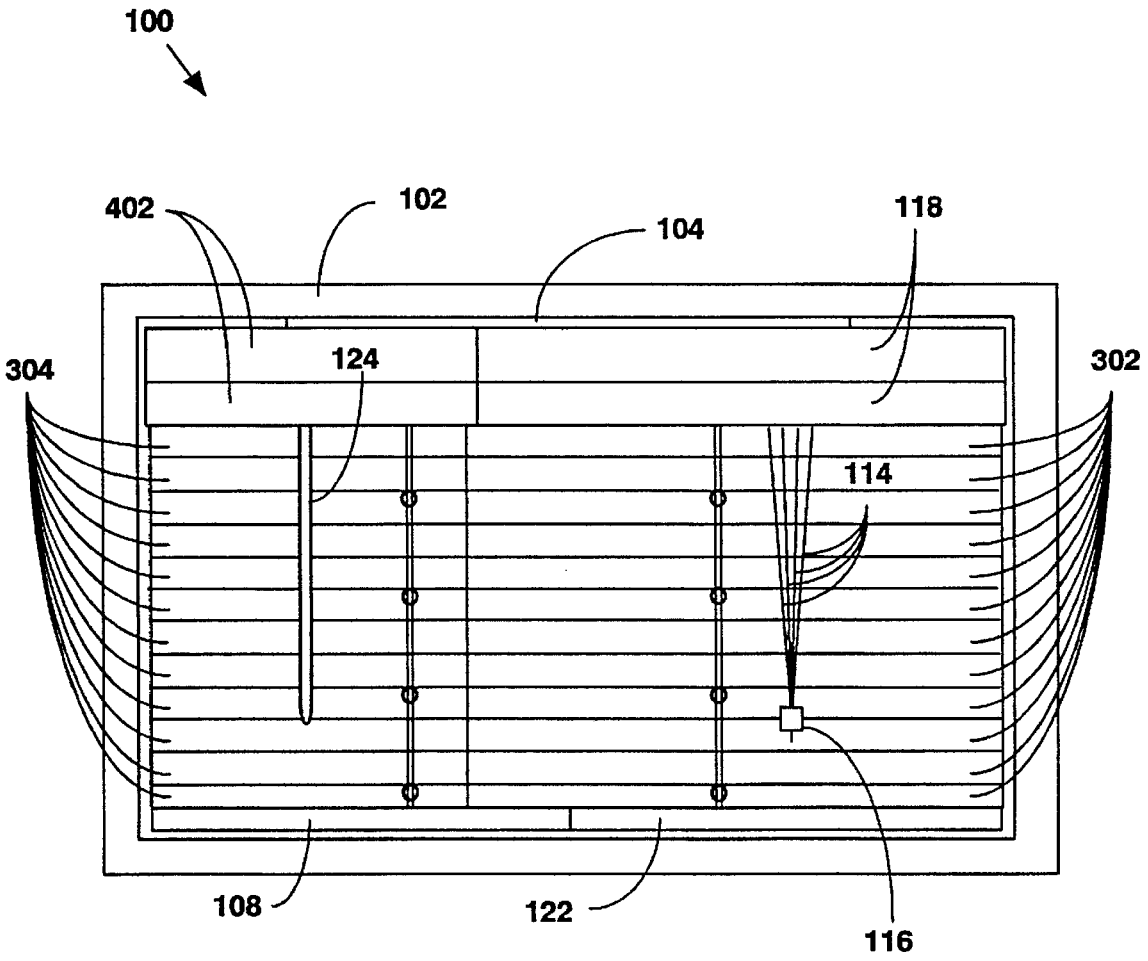
FIG. 4 is a front view of the embodiment of FIG. 1 with the adjustable venetian blinds in the extended position. This view illustrates the venetian blind in a typical rectangular window frame.

FIG. 4 is a front view of the preferred embodiment in the extended position. As can be seen, slat extensions 302, 304 are extended in opposite directions such that slat 106 is extended in width to fill window frame 102. Also shown in this figure is valance extension 402. Valance 118 and valance extension 402 are held by a valance grip (not shown) implemented in the same manner as slat extension holder 306. Valance 118 and valance extension 402 can be identical and interchangeable. For purposes of discussion, they are considered to be adjustable valance segments. This allows the valance 118 to be adjusted in width in the same manner as slats 106. An important advantage of the invention is that it allows an inexpensive adjustable venetian blind 100 to be installed by a user rather than requiring the user to purchase a more expensive custom made venetian blind. Further, the slat extensions 302, 304 can be replaced for maintenance or for esthetic reasons.

Figure 5:
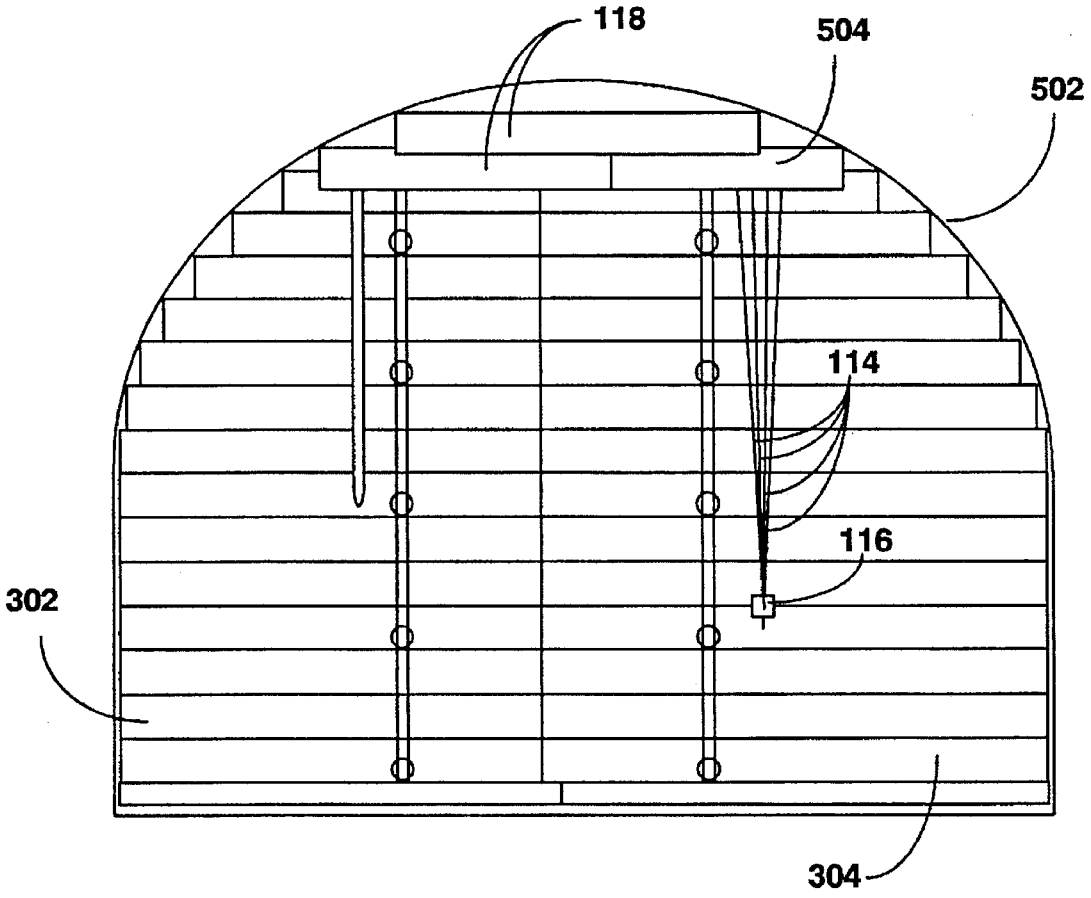
FIG. 5 is a front view of the embodiment of FIG. 1 with the adjustable venetian blinds in the extended position. This view illustrates the individually adjustable slats in the venetian blind adjusted to fit an irregularly shaped window frame.

FIG. 5 illustrates a unique advantage associated with the preferred embodiment. Namely, the individually adjustable slats 106 of the present invention provide the ability to use a standard, off-the-shelf adjustable venetian blind for odd shaped windows. Prior to the invention of the individually adjustable slat 106, venetian blinds for odd shaped windows had to be custom made at high cost. As shown in FIG. 5, the adjustable venetian blind 100 is mounted in an arched window. The advantage of individually adjusting slat width is that the slats 106 can be adjusted to fit the contours of a particular window. The prior art venetian blinds are incapable of use in this manner since the location of cords running through cord holes in the slats prevents slats from being adjusted individually.

Of course, it is also possible to mix fixed width slats with the independently adjustable slats discussed above. This configuration could be used in arched windows (as shown in FIG. 5) where only the top slats would be adjusted in width.

Figure 6:
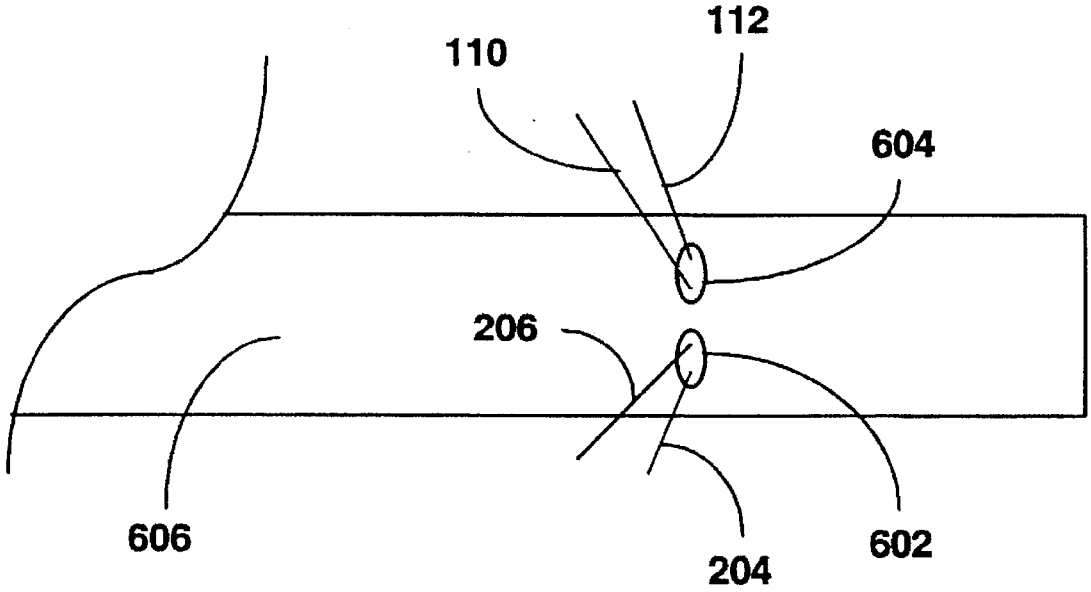
FIG. 6 is a bottom view of a prior art headrail used with standard venetian blinds.

FIG. 6 is a bottom view of a prior art headrail 606. Prior art headrails 606 use a pair of apertures 602, 604 at each end of the headrail 606 to accommodate tilt and lift cords 110, 112, 204, 206. The use of only two apertures prevents the rear lift cord 204 from being offset from rear tilt cord 206.

Figure 7:
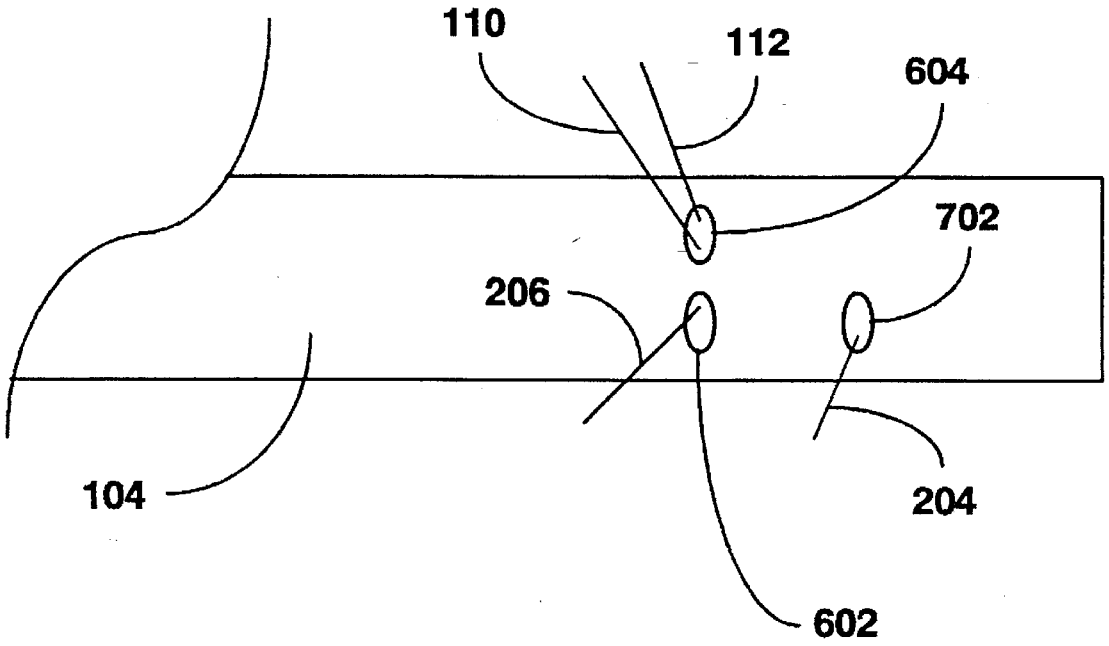
FIG. 7 is a bottom view of the headrail used in the preferred embodiment showing the offset cord aperture.

FIG. 7 illustrates the headrail 104 of the preferred embodiment. An additional aperture 702 is added and the lift cord is routed through it to provide an offset between the rear tilt cord 206 and the rear lift cord 204.

A result of removing the prior art cord holes from the slats 106 and routing the cords 110, 112, 204, 206 along the outer edge of the slats 106 is that the slats now accomplish several functions not heretofore available.

First, the absence of the cord holes eliminates the disadvantage of light entering a room though the cord holes regardless of the tilt position of the slats.

Second, and more important, since the movement of the individual slats 106 are no longer constrained by the cords which ran through the slats in prior art venetian blinds, slats 106 can now be made in slidable multi-layer form wherein each slidable layer is width adjusted independently of the width adjustment of the other slats 106 in the venetian blind 100. As a result of this feature, the adjustable venetian blind 100 can be used off-the-shelf for a variety of window sizes, resulting in a substantial savings to the consumer since the consumer can avoid purchasing expensive custom made prior art venetian blinds. The addition of the offset lift cord guide 202 and offset lift cord aperture 702 provide additional stability to the slat structure.

Third, since each slat 106 is independently adjustable, the venetian blind 100 can also be used for odd shaped or arched windows similar to that discussed above in regard to FIG. 5. This feature provides a substantial savings to the consumer. Heretofore, a consumer with a window shaped like the window in FIG. 5 was required to have venetian blinds custom made since the possibility of finding the correct size in an off-the-shelf venetian blind was remote. The venetian blind 100 presented herein allows the consumer to purchase an inexpensive, off-the-shelf venetian blind 100 which can fit a broad range of odd shaped window sizes due to the independently adjustable slats 106.

Fourth, the removable nature of the slat extensions 302, 304 and valance segments 118, 402 allow the user to periodically alter the appearance of odd shaped venetian blinds 100. A process which would have been prohibitively expensive with the custom made odd shaped venetian blinds of the prior art.

While the invention has been described with respect to a preferred embodiment thereof, it will be understood by those skilled in the art that various changes in detail my be made therein without departing from the spirit, scope, and teaching of the invention. For example, the number of slat extensions can vary, the material used to manufacture the slats can vary, etc. Accordingly, the invention herein disclosed is to be limited only as specified in the following claims.

I claim:

1. An adjustable venetian blind, comprising:

a headrail having a lilt cord drive assembly and a tilt cord drive assembly;

lift cords attached to the lift cord drive assembly in the headrail;

tilt cords attached to the tilt cord drive assembly in the headrail, each tilt cord further comprising a front tilt cord, a rear tilt cord and a plurality of cord rungs connecting the front tilt cord and the rear tilt cord; and a plurality of elongate slats, at least one of which is an independently adjustable slat, each slat comprising:

an elongate slat extension holder having a front side edge and a rear side edge along opposing longitudinal edges of said slat extension holder, the slat extension holder further having edge grips at both side edges;

at least two elongate slat extensions, the slat extensions inserted in the slat extension holder one overlapping another and slidably held by the edge grips, each slat extension independently movable in relation to the other slat extension holder such that the width of the slat can be varied independently of other slats in the venetian blind;

the tilt cords and lift cords extending outside of and adjacent to the side edges of the slats such that each slat rests on at least a pair of cord rungs and neither the tilt cords or the lift cords pass through a slat;

at least one slat extension holder having means to retain a tilt cord;

at least on slat extension holder having means to retain a lift cord;

whereby the width of the independently adjustable slat in the venetian blind can be independently varied from the width of the other slats in the venetian blind.

2. An adjustable venetian blind, as in claim 1, wherein at least one of the slats has a front cord guide attached.

3. An adjustable venetian blind, as in claim 2, wherein at least one of the slats has a lift cord guide attached, the lift cord guide offset from the tilt cord such that it does not interfere with operation of the tilt cord.

4. An adjustable venetian blind, as in claim 3, wherein the headrail further comprises a first set of rear tilt cord apertures and a second set of rear lift cord apertures, the rear lift cord apertures offset from the tilt cord apertures and substantially aligned with the lift cord guide such that when the lift cord exits the headrail it is in substantial alignment with the lift cord guide.

5. An adjustable venetian blind, as in claim 4, further comprising a width adjustable valance, the width adjustable valance having at least two adjustable valance segments capable of independent lateral extension;

whereby the width of the valance can be independently varied from the width of the slats.

6. An adjustable venetian blind, as in claim 5, further comprising a width adjustable bottom rail, the width adjustable bottom rail having at least two adjustable segments capable of independent lateral extension;

whereby the width of the bottom rail can be independently varied from the width of the slats.

7. An adjustable venetian blind, as in claim 6, wherein the slat extensions are removable without tampering with the lift or tilt cords.

8. An adjustable venetian blind, as in claim 1, wherein at least one of the slats has a lift cord guide attached, the lift cord guide offset from the tilt cord such that it does not interfere with operation of the tilt cord.

9. An adjustable venetian blind, as in claim 8, wherein the headrail further comprises a first set of rear tilt cord apertures and a second set of rear lift cord apertures, the rear lift cord apertures offset from the tilt cord apertures and substantially aligned with the lift cord guide such that when the lift cord exits the headrail it is in substantial alignment with the lift cord guide.

10. An adjustable venetian blind, as in claim 9, further comprising a width adjustable valance, the width adjustable valance having at least two adjustable valance segments capable of independent lateral extension;

whereby the width of the valance can be independently varied from the width of the slats.

11. An adjustable venetian blind, as in claim 10, further comprising a width adjustable bottom rail, the width adjustable bottom rail having at least two adjustable segments capable of independent lateral extension;

whereby the width of the bottom rail can be independently varied from the width of the slats.

12. An adjustable venetian blind, as in claim 11, wherein the slat extensions are removable without tampering with the lift or tilt cords.

13. An adjustable venetian blind, as in claim 1, further comprising a width adjustable valance, the width adjustable valance having at least two adjustable valance segments capable of independent lateral extension;

whereby the width of the valance can be independently varied from the width of the slats.

14. An adjustable venetian blind, as in claim 13, further comprising a width adjustable bottom rail, the width adjustable bottom rail having at least two adjustable segments capable of independent lateral extension;

whereby the width of the bottom rail can be independently varied from the width of the slats.

15. An adjustable venetian blind, as in claim 14, wherein the slat extensions are removable without tampering with the lift or tilt cords.

16. An adjustable venetian blind, as in claim 1, further comprising a width adjustable bottom rail, the width adjustable bottom rail having at least two adjustable segments capable of independent lateral extension;

whereby the width of the bottom rail can be independently varied from the width of the slats.

17. An adjustable venetian blind, as in claim 16, wherein the slat extensions are removable without tampering with the lift or tilt cords.

18. An adjustable venetian blind, comprising:

a headrail having a lift cord drive assembly and a tilt cord drive assembly;

lift cords attached to the lift cord drive assembly in the headrail;

tilt cords attached to the tilt cord drive assembly in the headrail, each tilt cord further comprising a front tilt cord, and a rear tilt cord; and a plurality of elongate slats, at least one of which is an independently adjustable slat, each slat comprising:

An elongate slat extension holder having a front side edge and a rear side edge along opposing longitudinal edges of said slat extension holder, the slat extension holder further having edge grips at both side edges;

at least two elongate slat extensions, the slat extensions inserted in the slat extension holder one overlapping another and slidably held by the edge grips, each slat extension independently movable in relation to the other slat extension holder such that the width of the slat can be varied independently of other slats in the venetian blind;

the front tilt cords retained by at least one slat extension holder and the rear tilt cords retained by at least one slat extension holder, each slat rests on at least a pair of cord rungs and neither the tilt cords or the lift cords pass through a slat;

whereby the width of the independently adjustable slat in the venetian blind can be independently varied from the width of the other slats in the venetian blind.

19. An adjustable venetian blind, as in claim 18, wherein at least one of the slats has a lift cord guide attached, the lift cord guide offset from the tilt cord such that it does not interfere with operation of the tilt cord.

20. An adjustable venetian blind, as in claim 19, wherein the headrail further comprises a first set of rear tilt cord apertures and a second set of rear lift cord apertures, the rear lift cord apertures offset from the tilt cord apertures and substantially aligned with the lift cord guide such that when the lift cord exits the headrail it is in substantial alignment with the lift cord guide.

* * * * *